US011969129B2

(12) United States Patent
Tondwal et al.

(10) Patent No.: US 11,969,129 B2
(45) Date of Patent: Apr. 30, 2024

(54) DISH TREATING APPLIANCE WITH A ROTATING ARM ASSEMBLY

(71) Applicant: WHIRLPOOL CORPORATION, Grand Rapids, MI (US)

(72) Inventors: Akshay Sanjay Tondwal, Pune (IN); Philip James Czarnecki, Saugatuck, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/840,899

(22) Filed: Jun. 15, 2022

(65) Prior Publication Data

US 2023/0404355 A1 Dec. 21, 2023

(51) Int. Cl.
*A47L 15/22* (2006.01)
*A47L 15/48* (2006.01)

(52) U.S. Cl.
CPC ..... *A47L 15/22* (2013.01); *A47L 15/483* (2013.01); *A47L 15/486* (2013.01); *A47L 15/488* (2013.01)

(58) Field of Classification Search
None
See application file for complete search history.

(56) References Cited

U.S. PATENT DOCUMENTS

| | | | |
|---|---|---|---|
| 2020/0163524 | A1 | 5/2020 | Jung et al. |
| 2020/0163531 | A1 | 5/2020 | Jung et al. |
| 2021/0022583 | A1 | 1/2021 | Jung et al. |

FOREIGN PATENT DOCUMENTS

| | | | |
|---|---|---|---|
| DE | 102007038673 | B3 | 1/2009 |
| EP | 2233057 | A1 | 9/2010 |
| GB | 2151464 | B | 7/1985 |

*Primary Examiner* — Levon J Shahinian
(74) *Attorney, Agent, or Firm* — McGarry Bair PC

(57) ABSTRACT

A dishwasher for treating dishes according to an automatic cycle of operation includes a tub at least partially defining a treating chamber with an access opening. A door selectively closes the access opening. At least one dish rack is located within the treating chamber. A rotating arm assembly is located within the tub below the at least one dish rack and has a rotatable hub with a liquid conduit. A spray arm is carried by the hub and fluidly coupled to the liquid conduit. An air mixing arm is carried by the hub.

17 Claims, 8 Drawing Sheets

DISH TREATING APPLIANCE WITH A ROTATING ARM ASSEMBLY

BACKGROUND

Contemporary automatic dishwashers for use in a typical household include a cabinet with an access opening and a tub that can have an open front and at least partially defines a treating chamber into which dishes (e.g., kitchenware, glassware, silverware, utensils, and the like) can be placed to undergo a treating operation, such as washing. At least one dish rack or basket for supporting soiled dishes is provided within the tub. At least an upper rack and a lower rack for holding dishes to be cleaned are typically provided within the treating chamber. A silverware basket for holding utensils, silverware, cutlery, and the like, is also usually provided and normally removably mounts to the door or within the dish rack.

A spraying system can be provided for recirculating liquid throughout the tub to remove soils from the dishes during a cycle of operation. The spraying system can include various sprayers, including one or more rotatable sprayers. Various sprayers of the spraying system can be configured to spray toward the racks or silverware basket. One specific type of sprayer that can be included within the spraying system is a rotating spray arm.

The cycles of operation can include multiple phases such as a washing phase, rinsing phase, and a drying phase. The phases are sometimes referred to as cycles. Traditional drying phases utilize various methods for drying dishes, examples of which include closed loop drying methods, such as by the use of a condenser, fan-assisted drying methods, or drying methods that include the use of a door opener to partially open a door of the dishwasher, which can be implemented with or without the use of a heater.

BRIEF DESCRIPTION

An aspect of the present disclosure relates to a dishwasher for treating dishes according to an automatic cycle of operation, the dishwasher comprising a tub at least partially defining a treating chamber with an access opening, a door selectively closing the access opening, at least one dish rack located within the treating chamber, an air inlet fluidly coupled to the treating chamber, an air outlet fluidly coupled to the treating chamber, and a rotating arm assembly located within the tub below the at least one dish rack and having a rotatable hub with a liquid conduit, a spray arm carried by the hub and fluidly coupled to the liquid conduit, and an air mixing arm carried by the hub and rotationally spaced from the liquid spray arm, wherein rotation of the hub rotates the air mixing arm to move air within the treating chamber whereby air is drawn in through the inlet and is expelled out the outlet to establish air flow through the treating chamber.

Another aspect of the present disclosure relates to a dishwasher for treating dishes according to an automatic cycle of operation, the dishwasher comprising a tub at least partially defining a treating chamber with an access opening, a door selectively closing the access opening, at least one dish rack located within the treating chamber, and a rotating arm assembly located within the tub below the at least one dish rack and having a rotatable hub with a liquid conduit, a spray arm carried by the hub and fluidly coupled to the liquid conduit, and an air mixing arm carried by the hub and rotationally spaced from the liquid spray arm, the air mixing arm comprising multiple, parallel blades, wherein rotation of the hub rotates the air mixing arm to move air within the treating chamber to establish air flow through the treating chamber.

DETAILED DESCRIPTION

Figure 1:
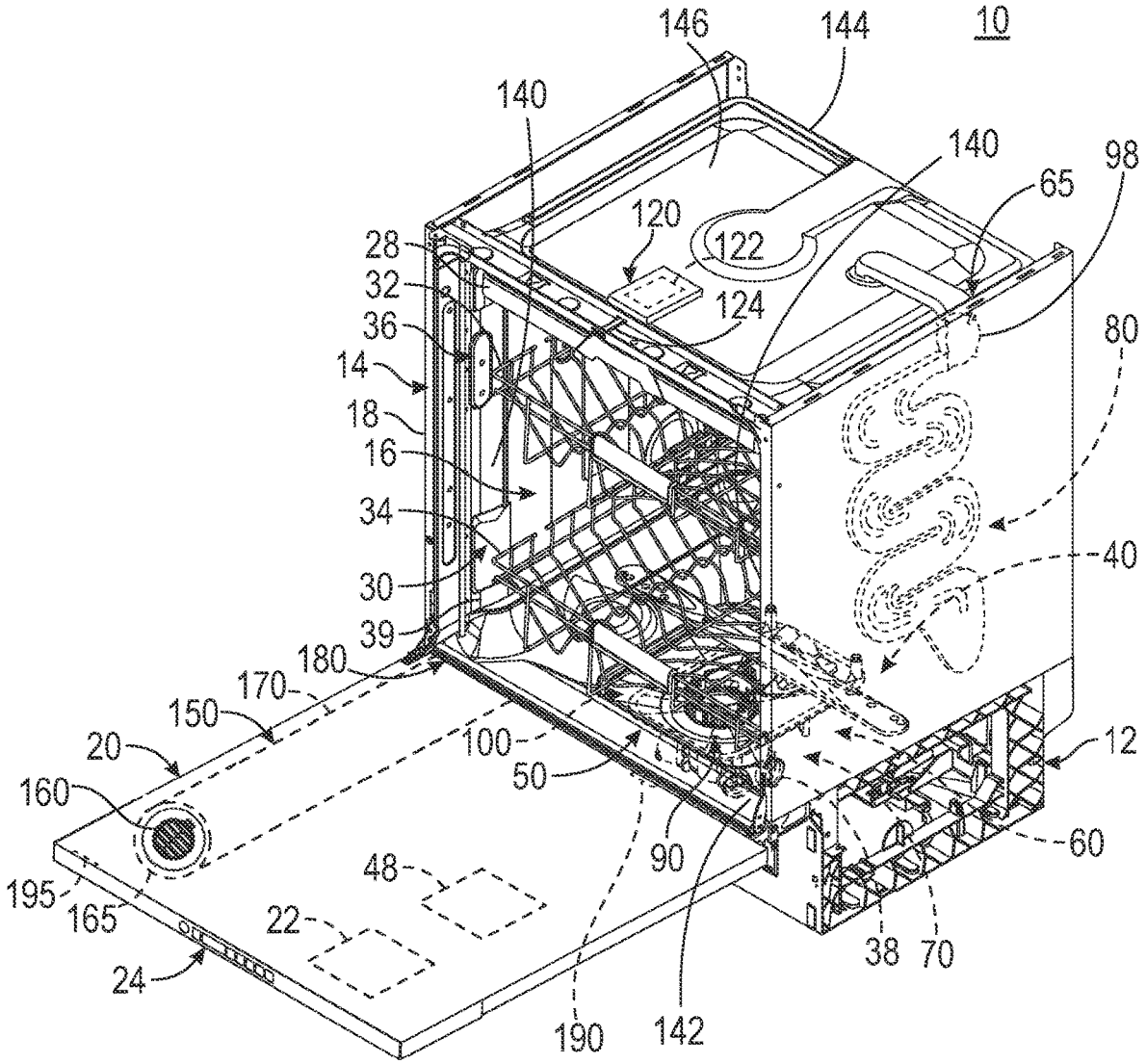
FIG. 1 is a right-side perspective view of a dish treating appliance, illustrated herein as a dishwasher, having multiple systems for implementing an automatic cycle of operation, including a spray system.

FIG. 1 illustrates an automatic dish treating appliance 10, illustrated herein as a dishwasher 10, capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, silverware, and other utensils. As illustrated, the dishwasher 10 is a built-in dishwasher 10 implementation, which is designed for mounting under a countertop or other work surface. However, this description is applicable to other dishwasher implementations such as a stand-alone, multi-tub-type, drawer-type, or a sink-type, for example, as well as dishwashers having varying widths, sizes, and capacities. The dishwasher 10 shares many features of a conventional automatic dishwasher, which may not be described in detail herein except as necessary for a complete understanding of aspects of the disclosure.

The dishwasher 10 has a variety of systems, some of which are controllable, to implement the automatic cycle of operation. A chassis or cabinet is provided to support the variety of systems needed to implement the automatic cycle of operation and can define an interior. As illustrated, for a built-in implementation, the chassis or cabinet includes a frame in the form of a base 12 on which is supported an open-faced tub 14, which at least partially defines a treating chamber 16, having an access opening, illustrated herein as an open face 18, for receiving the dishes. The open-faced tub 14 can have at least a pair of opposing side walls 140 that are spaced apart from one another, such as by being spaced apart by a bottom wall 142, a rear wall 144, and/or a top wall 146. The pair of opposing side walls 140, the bottom wall 142, the rear wall 144, and the top wall 146 can further be thought of as at least partially defining the treating chamber 16, and optionally also the open face 18 to serve as the access opening.

A closure in the form of a door assembly 20 can be hingedly or pivotally mounted to the base 12, or to any other suitable portion of the cabinet or chassis or of the tub 14, for movement relative to the tub 14 between opened and closed positions to selectively open and close the open face 18 of the tub 14. In one example, the door assembly 20 is mounted for pivoting movement about a pivot axis relative to the base 12, the tub 14, or the open face 18. In the opened position, a user can access the treating chamber 16, as shown in FIG. 1, while, in the closed position (not shown), the door assembly 20 covers or closes the open face 18 of the treating chamber 16. Thus, the door assembly 20 provides selective accessibility to the treating chamber 16 for the loading and unloading of dishes or other items. A closure or latch assembly (not shown) can be provided to selectively retain the door assembly 20 in the closed position.

A door opening assembly 120, illustrated herein as a door opener 120, is provided with the dishwasher 10 to selectively bias the door assembly 20 toward the opened position. It is further contemplated that the door opener 120 can selectively bias and move the door assembly 20 into a partially open position (not shown) between the closed and opened positions. The partially open position can be defined by the angle of rotation of the door assembly 20 relative to the open face 18. By way of non-limiting example, the door opener 120 can be selectively actuated to move the door assembly 20 into the partially open position wherein the door assembly 20 is rotated at least 5 degrees away from the open face 18, further wherein the door assembly 20 is rotated at least 8 degrees away from the open face 18, further yet wherein the door assembly 20 is rotated about 10 degrees away from the open face 18. The door opener 120 can be provided at any suitable location within the dishwasher 10, such as coupled to or mounted to the tub 14 or to another portion of the chassis or cabinet or the dishwasher 10. The door opener 120 comprises an actuating mechanism 122 that is operably coupled with an opening pin 124 to selectively actuate the opening pin 124 to move from a non-actuated or retracted position to an actuated or extended position wherein the opening pin 124 contacts and bears against the door assembly 20 to bias and to move the door assembly 20 toward and into the partially open position.

The chassis or cabinet, as in the case of the built-in dishwasher implementation, can be formed by other parts of the dishwasher 10, like the tub 14 and the door assembly 20, in addition to a dedicated frame structure, like the base 12, with them all collectively forming a uni-body frame by which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, spray system 40, recirculation system 50, drain system 60, water supply system 70, air supply system 65, first drying system 80, heating system 90, filter system 100, and second drying system 150. These systems are used to implement one or more treating cycles of operation for the dishes, for which there are many, one of which includes a traditional automatic wash cycle.

A basic traditional automatic cycle of operation for the dishwasher 10 has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The amounts of water, treating chemistry, and/or rinse aid used during each of the multiple wash or rinse steps can be varied. The wash phases and rinse phases can include the heating of the water, even to the point of one or more of the phases being hot enough for long enough to sanitize the dishes. A drying phase can follow the rinse phase(s). The drying phase can include a drip dry, a non-heated drying step (so-called "air only"), heated dry, condensing dry, air dry or any combination. These multiple phases or steps can also be performed by the dishwasher 10 in any desired combination.

A controller 22 can also be included in the dishwasher 10 and operably couples with and controls the various components of the dishwasher 10 to implement the cycles of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can provide an input and output function for the controller 22.

The user interface 24 can include operational controls such as one or more knobs, dials, lights, switches, displays, touch screens and the like for communicating with the user, such as enabling a user to input commands, such as a cycle of operation, to the controller 22 and to receive information, for example about the selected cycle of operation. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the dishwasher 10 and can allow the controller 22 to communicate with the user in a variety of ways. For example, the controller 22 can be configured to send a text message to the user, send an electronic mail to the user, or provide audio information to the user either through the dishwasher 10 or utilizing another device such as a mobile phone.

The controller 22 can include the machine controller and any additional controllers provided for controlling any of the components of the dishwasher 10. For example, the controller 22 can include the machine controller and a motor controller. Many known types of controllers can be used for the controller 22. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

The dish holding system 30 can include any suitable structure or structures for receiving or holding dishes within the treating chamber 16. Exemplary dish holders are illustrated in the form of an upper dish rack 32 and lower dish rack 34, commonly referred to as "racks", which are located within the treating chamber 16. The upper dish rack 32 and the lower dish rack 34 each define an interior and are typically mounted for slidable movement in and out of the treating chamber 16 through the open face 18 for ease of loading and unloading. In one example, it is common for the upper dish rack 32 to be slidably mounted within and to the tub 14 by the use of a suitable drawer withdrawal assembly, such as by the use of drawer guides, slides, or rails 36, while the lower dish rack 34 is instead typically provided with wheels or rollers 38 that can roll along a travel path 39 defined by at least a portion of the dishwasher 10. For example, it is typical for the lower dish rack 34 to be slidable along the travel path 39 such that the lower dish rack 34 can roll along the travel path 39 and then continue to roll onto the door assembly 20, when the door assembly 20 is in the opened position and allows for withdrawal of the dish racks 32, 34.

By way of further example, in such a case, it is also typical that the travel path 39 can include a type of rails 39, but that rails 39 for the lower dish rack 34 may differ in structure from the rails 36 for the upper dish rack 32, and in particular such that the rails 39 may be provided simply as a ledge or a surface formed by the tub 14, such as formed or carried by the side walls 140 or the bottom wall 142 of the tub 14. By providing the rails 39 for the lower dish rack 34 as a simpler support surface, such as a ledge, rather than a more restrictive or enclosing structure such as the rails 36, the rails 39 are better able to accommodate movement or instability of the lower dish rack 34 as the lower dish rack 34 rolls onto the door assembly 20, going from the static, stable tub 14 to the movable door assembly 20. In this way, the rails 39 allow more tolerance for movement as the lower dish rack 34 rolls along the door assembly 20.

In addition, dedicated dish holders can also be provided. One such dedicated dish holder is a third level rack 28 located above the upper dish rack 32. Like the upper dish rack 32, the third level rack 28 is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack 28, it can be washed in the third level rack 28. The third level rack 28 generally has a much shorter height or lower profile than the upper and lower dish racks 32, 34. Typically, the height of the third level rack 28 is short enough that a typical glass cannot be stood vertically in the third level rack 28 and the third level rack 28 still be slid into the treating chamber 16.

Another dedicated dish holder can be a utensil or silverware basket (not shown), which is typically located in the treating chamber 16 and carried by one of the upper or lower dish racks 32, 34 or mounted to the door assembly 20. The silverware basket typically holds utensils and the like in an upright orientation as compared to the on-the-side or flat orientation of the third level rack 28. More than one silverware basket can be provided with the dishwasher 10.

A dispenser assembly 48 is provided to store and dispense treating chemistry, e.g. detergent, anti-spotting agent, etc., into the treating chamber 16. The dispenser assembly 48 can be mounted on an inner surface of the door assembly 20, as shown, or can be located at other positions within the chassis or treating chamber 16, such that the dispenser assembly 48 is positioned to be accessed by the user for refilling of the dispenser assembly 48, whether it is necessary to refill the dispenser assembly 48 before each cycle (i.e. for a single use dispenser) or only periodically (i.e. for a bulk dispenser). The dispenser assembly 48 can dispense one or more types of treating chemistries. The dispenser assembly 48 can be a single-use dispenser, which holds a single dose of treating chemistry, or a bulk dispenser, which holds a bulk supply of treating chemistry and which is adapted to dispense a dose of treating chemistry from the bulk supply during the cycle of operation, or a combination of both a single use and bulk dispenser. The dispenser assembly 48 can further be configured to hold multiple different treating chemistries. For example, the dispenser assembly 48 can have multiple compartments defining different chambers in which treating chemistries can be held.

Figure 2:
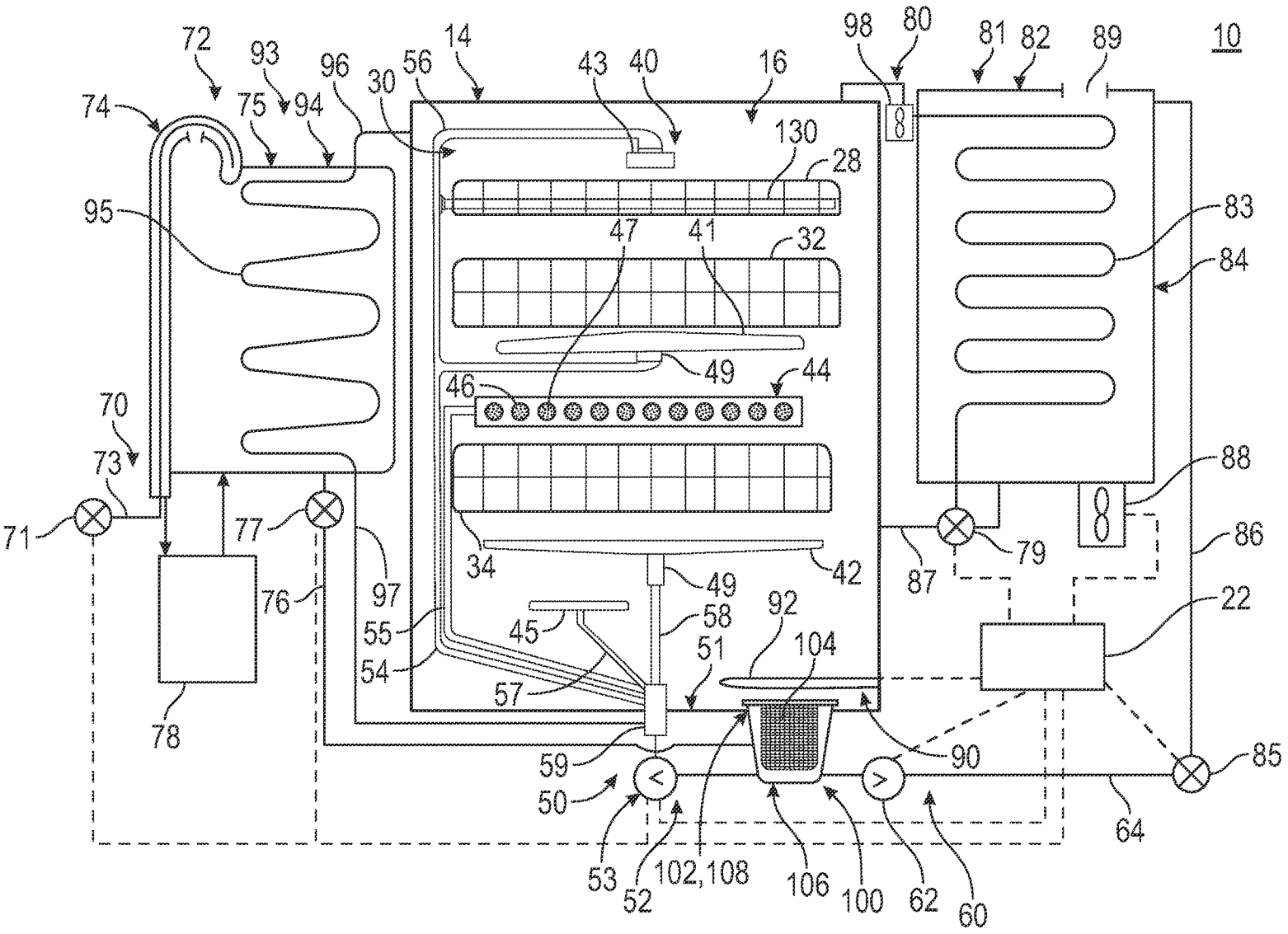
FIG. 2 is a schematic view of the dishwasher of FIG. 1 and illustrating at least some of the systems.

Turning to FIG. 2, the spray system 40 is provided for spraying liquid in the treating chamber 16 and can have multiple spray assemblies or sprayers 41, 42, 43, 44, 45, 130, some of which can be dedicated to a particular one of the dish holders, to particular area of a dish holder, to a particular type of cleaning, or to a particular level of cleaning, etc. The sprayers 41, 42, 43, 44, 45, 130 can be fixed or movable, such as rotating, relative to the treating chamber 16 or dish holder. Exemplary sprayers 41, 42, 43, 44, 45, 130 are illustrated and include an upper spray arm 41, a lower spray arm 42, a third level sprayer 43, a deep-clean sprayer 44, and a spot sprayer 45. The upper spray arm 41 and lower spray arm 42 can be rotating spray arms, located below the upper dish rack 32 and lower dish rack 34, respectively, and rotate about a generally centrally located and vertical axis. In one non-limiting example, at least one drive assembly, illustrated herein as at least one motor 49, is operably coupled to one of or to each of the upper spray arm 41 and the lower spray arm 42 in order to control and drive rotation of the lower spray arm 42. In place of or in addition to the at least one motor 49, the drive assembly can be hydraulically driven, such that liquid emitted from one of or to each of the upper spray arm 41 and the lower spray arm 42 through nozzles can effect the rotation of the one of or each of the upper spray arm 41 and the lower spray arm 42. While the sprayers 41, 42 can thus be hydraulically driven, rather than motor-driven, it is also contemplated that the sprayers 41, 42 can be both hydraulically and motor-driven, such as that the sprayers 41, 42 can be hydraulically driven during a wash phase and motor-driven during a drying phase when liquid is not being emitted. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28, though it will be understood that such a sprayer 130 can be provided adjacent any of the racks 28, 32, 34. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or can move, such as by way of rotating. The spray emitted by the deep-clean sprayer 44 defines a deep clean zone, which, as illustrated, would extend along a rear side of the lower dish rack 34. Thus, dishes needing deep cleaning, such as dishes with baked-on food, can be positioned in the lower dish rack 34 to face the deep-clean sprayer 44. The deep-clean sprayer 44, while illustrated as only one unit on a rear wall of the tub 14, could comprise multiple units and/or extend along multiple portions, including different walls, of the tub 14, and can be provided above, below, or beside any of the dish holders 28, 32, 34 wherein deep cleaning is desired.

The spot sprayer 45, like the deep-clean sprayer 44, can emit an intensified and/or higher pressure spray, especially to a discrete location within one of the dish holders 28, 32, 34. While the spot sprayer 45 is shown below the lower dish rack 34, it could be adjacent any part of any dish holder 28, 32, 34 or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as in rotating.

These sprayers 41, 42, 43, 44, 45, 130 are illustrative examples of suitable sprayers and are not meant to be limiting as to the type of suitable sprayers 41, 42, 43, 44, 45, 130. Additionally, it will be understood that not all of the exemplary sprayers 41, 42, 43, 44, 45, 130 need be included within the dishwasher 10, and that less than all of the sprayers 41, 42, 43, 44, 45, 130 described can be included in a suitable dishwasher 10.

The recirculation system 50 recirculates the liquid sprayed into the treating chamber 16 by the sprayers 41, 42, 43, 44, 45, 130 of the spray system 40 back to the sprayers 41, 42, 43, 44, 45, 130 to form a recirculation loop or circuit by which liquid can be repeatedly and/or continuously sprayed onto dishes in the dish holders 28, 32, 34. The recirculation system 50 can include a sump 51 and a pump assembly 52. The sump 51 collects the liquid sprayed in the treating chamber 16 and can be formed by a sloped or recess portion of the bottom wall 142 of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 41, 42, 43, 44, 45, 130 to the recirculation pump 53. A recirculation valve 59 can selectively fluidly couple each of the conduits 54, 55, 56, 57, 58 to the recirculation pump 53. While each sprayer 41, 42, 43, 44, 45, 130 is illustrated as having a corresponding dedicated supply conduit 54, 55, 56, 57, 58, one or more subsets, comprising multiple sprayers from the total group of sprayers 41, 42, 43, 44, 45, 130, can be supplied by the same conduit, negating the need for a dedicated conduit 54, 55, 56, 57, 58 for each sprayer 41, 42, 43, 44, 45, 130. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54, 55, 56, 57, 58 can be directly coupled to the recirculation pump 53, while one or more of the other conduits 54, 55, 56, 57, 58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system includes a drain pump 62 fluidly coupling the treating chamber 16 to a drain line 64. As illustrated, the drain pump 62 fluidly couples the sump 51 to the drain line 64.

While separate recirculation 53 and drain pumps 62 are illustrated, a single pump can be used to perform both the recirculating and the draining functions, such as by configuring the single pump to rotate in opposite directions, or by providing a suitable valve system. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to at least some extent.

A water supply system 70 is provided for supplying fresh water to the dishwasher from a water supply source, such as a household water supply via a household water valve 71. The water supply system 70 includes a water supply unit 72 having a water supply conduit 73 with a siphon break 74 or an air break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 can be provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

An air supply system 65 is optionally provided to aid in the treating of the dishes during the cycle of operation by supplying air to at least a portion of the dishwasher 10, a non-limiting example of which includes the treating chamber 16. The air supply system 65 can include a variety of assemblies, pathways, and circuits for supplying air to different portions of the dishwasher 10 and for different purposes within the dishwasher 10, such that the air supply system 65 can be thought of as comprising all of the air supplying or air circulating portions of the dishwasher 10. In one non-limiting example, the air supply system 65 comprises a first drying system 80 that is provided to aid in the drying of the dishes during the drying phase. The first drying system 80, which can be thought of as a condensing drying system 80, as illustrated, by way of non-limiting example, includes a condensing assembly 81 having a condenser 82 formed of a serpentine conduit 83 with an inlet fluidly coupled to an upper portion of the tub 14, fluidly coupled to the treating chamber 16 and which can be thought of as an air outlet of the treating chamber 16, and an outlet fluidly coupled to a lower portion of the tub 14, fluidly coupled to the treating chamber 16 and which can be thought of as an air inlet of the treating chamber 16, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber 16, or a combination of both by operating in one configuration and then the other configuration. A fan or blower 98 can be fluidly coupled with the serpentine conduit 83 to move air through the serpentine conduit 83. It will also be understood that the serpentine conduit 83 is not limited to having a serpentine shape and can instead be provided with any suitable size and shape.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60, or water supply system 70, such that liquid can be supplied to the cooling tank 84. The liquid provided to the cooling tank 84 from any of the systems 40, 50, 60, 70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The condensing drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected based on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heating element, illustrated herein as a heater 92, such as an immersion heater 92, located in the treating chamber 16 at a location where it will be immersed by the water supplied to the treating chamber 16, such as within or near the sump 51. However, it will also be understood that the heater 92 need not be an immersion heater 92; it can also be an in-line heater located in any of the conduits. There can also be more than one heater 92, including both an immersion heater 92 and an in-line heater. The heater 92 can also heat air contained in the treating chamber 16. Alternatively, a separate heating element (not shown) can be provided for heating the air circulated through the treating chamber 16.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system can include a rotating filter in addition to or in place of the either or both of the coarse filter 102 and fine filter 104. Other filter arrangements are contemplated, such as an ultrafiltration system.

Additionally, or alternatively, to the condensing drying system 80, the dishwasher can further optionally include a second drying system 150, which can be a fan-assisted drying system 150, that is provided to aid in the drying of the dishes during the drying cycle or phase by moving air through or within the treating chamber 16, and which can be thought of as being provided in addition to or as part of the air supply system 65. The drying system 150 as illustrated is provided with and carried by the door assembly 20, though it will be understood that such position is not limiting and the drying system 150 can be provided in any suitable location, such as with a wall of the tub 14. The drying system 150 includes an air conduit 170 extending within the door assembly 20 and having an inlet 160 provided on the door assembly 20, fluidly coupled to the treating chamber 16 and which can be thought of as an air outlet of the treating chamber 16, such as at an upper portion of the door assembly 20, and an outlet 180 fluidly coupled to ambient air exterior of the dishwasher 10 at a lower portion of the door assembly 20. A fan or blower 165 is fluidly coupled with the air conduit 170, such as fluidly coupled with and located at the inlet 160, to force air through the air conduit 170. The drying system 150 is provided such that moisture laden air within the tub 14 is drawn by the blower 165 from the air outlet of the treating chamber 16 at the upper portion of the tub 14 to pass through the drying system inlet 160 and into the air conduit 170 to be ultimately exhausted or emitted into ambient air exterior of the dishwasher 10 via the outlet 180. In this way, the outlet 180 fluidly couples the air outlet of the treating chamber 16 with the ambient air, and thus the drying system inlet 160, which is thought of as the air outlet of the treating chamber 16, fluidly couples the treating chamber 16 to ambient air. While the drying system 150 is illustrated herein as being operated in an open loop configuration, where the air is exhausted to atmosphere, it is also contemplated that the drying system 150 can be operated in a closed loop configuration, where the air is returned to the treating chamber 16, or a combination of both by operating in one configuration and then the other configuration.

Whether the drying system 150 is operated in the closed loop configuration, the open loop configuration, or a combination of both, the dishwasher 10 can further include an air inlet, illustrated herein as a vent 190, that is fluidly coupled to the treating chamber 16 and can be thought of as an air inlet to the treating chamber 16. The vent 190 is further fluidly coupled to ambient air exterior of the dishwasher 10, thus fluidly coupling the treating chamber 16 to ambient air, for allowing ambient air flow into the treating chamber 16. While the vent 190 is illustrated herein as being positioned at a lower portion of the door assembly it will be understood that the vent 190 can be provided at any suitable location within the dishwasher 10, such as at another location on the door assembly, or at a portion of the open face 18. The vent 190 can be a passive vent 190, or can be fluidly coupled with a fan or blower (not shown) to act as an active vent 190. The vent 190 can be provided in an always-open configuration, or can be selectively opened and closed. While the vent 190 is illustrated herein as being provided in combination with the drying system 150, it will be understood that the vent 190 can be provided to further improve drying performance by providing ambient air to the treating chamber 16 during a drying cycle, either in addition to the condensing drying system 80 and without the drying system 150, in addition to both the condensing drying system 80 and the drying system 150, or in addition to the drying system 150 and without the condensing drying system 80, in the case that the drying system 150 is provided to replace the condensing drying system 80.

Similarly, whether the drying system 150 is operated in the closed loop configuration, the open loop configuration, or a combination of both, the dishwasher 10 can further include an air outlet, illustrated herein as a vent 195, that is fluidly coupled to the treating chamber 16 and can be thought of as an air outlet to the treating chamber 16. The vent 195 is further fluidly coupled to ambient air exterior of the dishwasher 10, thus fluidly coupling the treating chamber 16 to ambient air, for allowing air flow from the treating chamber 16 into the ambient air. While the vent 195 is illustrated herein as being positioned at an upper portion of the door assembly 20, it will be understood that the vent 195 can be provided at any suitable location within the dishwasher 10, such as at another location on the door assembly, or at a portion of the open face 18. The vent 195 can be a passive vent 195, or can be fluidly coupled with a fan or blower (not shown) to act as an active vent 195. The vent 195 can be provided in an always-open configuration, or can be selectively opened and closed. While the vent 195 is illustrated herein as being provided in combination with the drying system 150, it will be understood that the vent 195 can be provided to further improve drying performance by providing air from the treating chamber 16 to the ambient air during a drying cycle, either in addition to the condensing drying system 80 and without the drying system 150, in addition to both the condensing drying system 80 and the drying system 150, or in addition to the drying system 150 and without the condensing drying system 80, in the case that the drying system 150 is provided to replace the condensing drying system 80.

Figure 3:
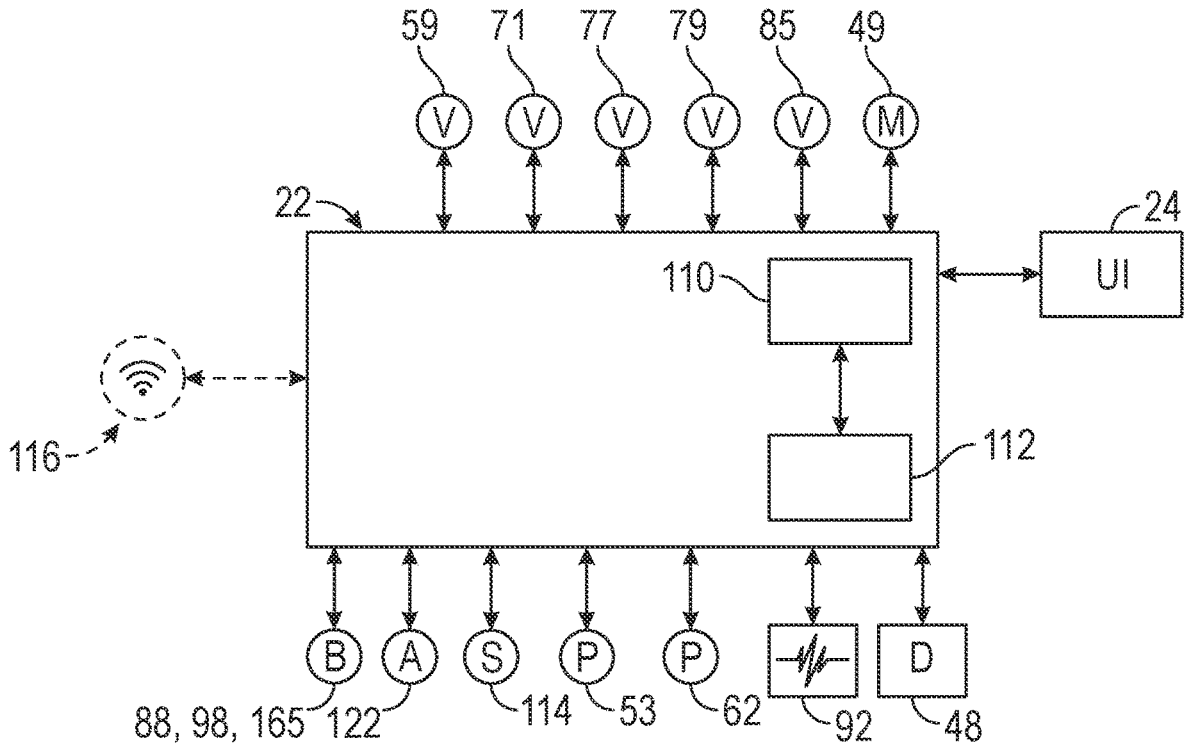
FIG. 3 is a schematic view of a controller of the dishwasher of FIGS. 1 and 2.

As illustrated schematically in FIG. 3, the controller 22 can be coupled with the heater 92 for heating the wash liquid or the air within the treating chamber 16 during a cycle of operation, the drain pump 62 for draining liquid from the treating chamber 16, the recirculation pump 53 for recirculating the wash liquid during the cycle of operation, the user interface 24 for receiving user selected inputs and communicating information to the user, the dispenser assembly 48 for selectively dispensing treating chemistry to the treating chamber 16, the at least one motor 49 for selectively actuating rotation of the upper spray arm 41 and/or the lower spray arm 42, the blower 88 for providing air into the cooling tank 84, the blower 98 for providing air through the serpentine conduit 83, the actuating mechanism 122 for controlling the operation of and selectively actuating the door opener 120 to move the door assembly 20 to the partially open position, and the blower 165 for moving air through the treating chamber 16 and into the drying system 150. The controller 22 can also communicate with the recirculation valve 59, the household water valve 71, the controllable valve 77, the return valve 79, and the valve 85 to selectively control the flow of liquid within the dishwasher 10. Optionally, the controller 22 can include or communicate with a wireless communication device 116.

The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store a set of executable instructions including one or more pre-programmed automatic cycles of operation that can be selected by a user and executed by the dishwasher 10. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 24. The memory 110 can also be used to store information, such as a database or table, and to store data received from one or more components of the dishwasher 10 that can be communicably coupled with the controller 22. The database or table can be used to store the various operating parameters for the one or more cycles of operation, including factory default values for the operating parameters and any adjustments to them by the control assembly or by user input.

The controller 22 can also receive input from one or more sensors 114 provided in one or more of the assemblies or systems of the dishwasher 10 to receive input from the sensors 114, which are known in the art and not shown for simplicity. Non-limiting examples of sensors 114 that can be communicably coupled with the controller 22 include, to name a few, an ambient air temperature sensor, a treating chamber temperature sensor, such as a thermistor, a water supply temperature sensor, a door open/close sensor, a moisture sensor, a chemical sensor, and a turbidity sensor to determine the soil load associated with a selected grouping of dishes, such as the dishes associated with a particular area of the treating chamber 16.

Figure 4:
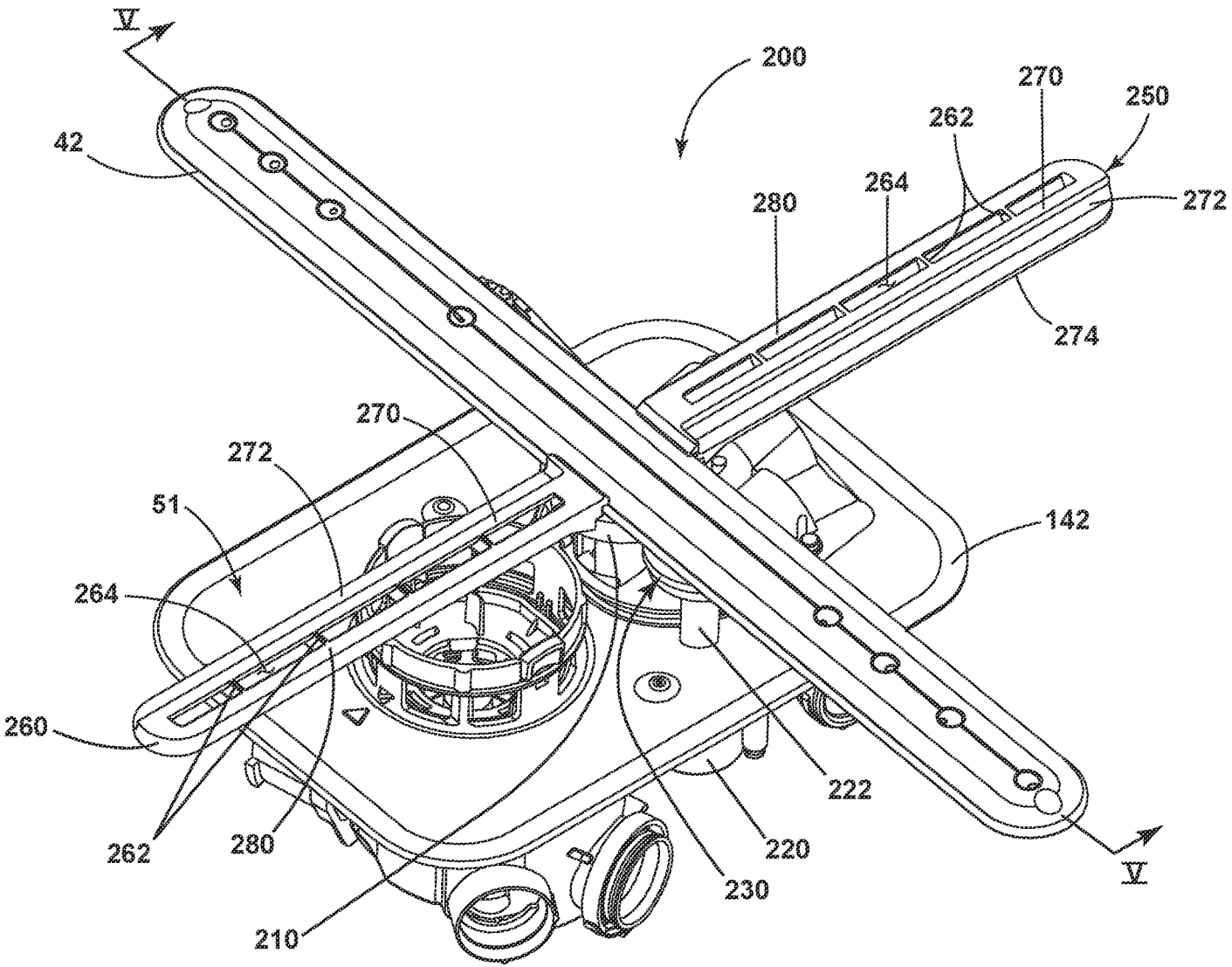
FIG. 4 is a perspective view of an example of a rotating arm assembly for use with the spray system of the dishwasher of FIG. 1, the rotating arm assembly including an air mixing arm.

Turning now to FIG. 4, an example of a rotating arm assembly 200 that can be used within the spray system 40 is illustrated as being provided with the lower spray arm 42, though it will be understood that the rotating arm assembly 200 can be provided with or at the position of any of the previously described sprayers 41, 42, 43, 44, 45, 130, particularly with either or both of the upper spray arm 41 and the lower spray arm 42, or at any other suitable position for a rotatable sprayer within the dishwasher 10. The rotating arm assembly 200 can emit liquid and/or move air within the treating chamber 16 upon rotation. The rotating arm assembly 200 comprises the lower spray arm 42 for emitting liquid into the treating chamber 16 and an air mixing arm 250 which, upon rotation of the rotating arm assembly 200, will effect a movement of the air to establish air flow within the treating chamber 16, much like a fan blade. The position and orientation of air mixing arms 250 on one or more rotating arm assemblies 200 within or throughout the treating chamber 16 can be selected in order to effect a particular air flow and/or circulation pattern or path within the treating chamber 16.

The rotating arm assembly 200 further comprises a rotatable hub 210 that carries both the lower spray arm 42 and the air mixing arm 250 and couples the lower spray arm 42 and the air mixing arm 250 to be stationary relative to one another and relative to the hub 210, such that rotation of the hub 210 rotates both the lower spray arm 42 and the air mixing arm 250. Therefore, the previously described rotation of the lower spray arm 42, whether driven hydraulically by liquid emitted from the lower spray arm 42 or driven by the motor 49, which can be thought of as a first motor 49, in turn carries rotation of both the hub 210 and the air mixing arm 250 along with the lower spray arm 42. The rotating arm assembly 200 additionally comprises a motor 220, which can be thought of as a second motor 220, operably coupled to and rotationally driving the hub 210, and therefore also the air mixing arm 250, independently of the first motor 49. The second motor 220 can be any suitable motor, such as, by way of non-limiting example, a direct current (DC) motor, which can be a 12V DC motor.

The second motor 220 is positioned outside of the treating chamber 16 and the tub 14, such as located exterior of and below the sump 51, and comprises an output shaft 222 that is operably coupled with and rotationally driven by the second motor 220. The output shaft 222 extends upwardly from the second motor 220, through the bottom wall 142 and into the tub 14 and the treating chamber 16 through the sump 51. The output shaft 222 is further operably coupled to and rotationally drives a gear assembly 230. The gear assembly 230 is further yet operably coupled to and rotationally drives the hub 210, such that the gear assembly 230 operably couples the output shaft 222 with the hub 210 and the air mixing arm 250. The controller 22 can be coupled with the second motor 220 for selectively actuating rotation of the hub 210 and the rotating arm assembly 200.

The coupling of the lower spray arm 42 and the air mixing arm 250 by the hub 210 positions the lower spray arm 42 and the air mixing arm 250 relative to one another such that the air mixing arm 250 is rotationally spaced or offset from the lower spray arm 42. In one non-limiting example, the lower spray arm 42 and the air mixing arm 250 are rotationally offset by 90 degrees, such that the lower spray arm 42 and the air mixing arm 250 are positioned generally orthogonally relative to one another. However, it will be understood that the lower spray arm 42 and the air mixing arm 250 can be rotationally offset by any suitable angle relative to one another. The lower spray arm 42 and the air mixing arm 250 can be coupled with one another by the hub 210 generally at a midpoint or a central portion of the lower spray arm 42 and the air mixing arm 250.

The air mixing arm 250 comprises a longitudinal body 260 defining multiple blades 270, 280, illustrated as a pair of spaced parallel blades 270, 280, though it will be understood that this example is not limiting and that the air mixing arm 250 can include any suitable number of blades 270, 280, which may or may not be parallel. The pair of blades 270, 280 are illustrated as a front blade 270 and a rear blade 280 defined in terms of a clockwise rotation of the rotating arm assembly 200 as seen from FIG. 4. At least one cross-member 262, illustrated as a plurality of cross-members 262, extends between and spaces apart the blades 270, 280 and at least partially defines at least one air flow channel 264 between the blades 270, 280. The front blade 270 defines a leading surface 272 that extends forwardly from the front blade 270 moving from an upper portion of the front blade 270 to a lower portion of the front blade 270 to terminate at a leading edge 274 at a lowermost and forwardmost extent of the front blade 270. The leading surface 272 is curved such that air that confronts the leading surface 272 as the air mixing arm 250 is rotated in the clockwise direction flows upwardly along the curved leading surface 272. At least the rear blade 280 can also be shaped such that air that confronts the rear blade 280 as the air mixing arm 250 is rotated in the clockwise direction flows upwardly along the rear blade 280 through the at least one air flow channel 264.

Figure 5:
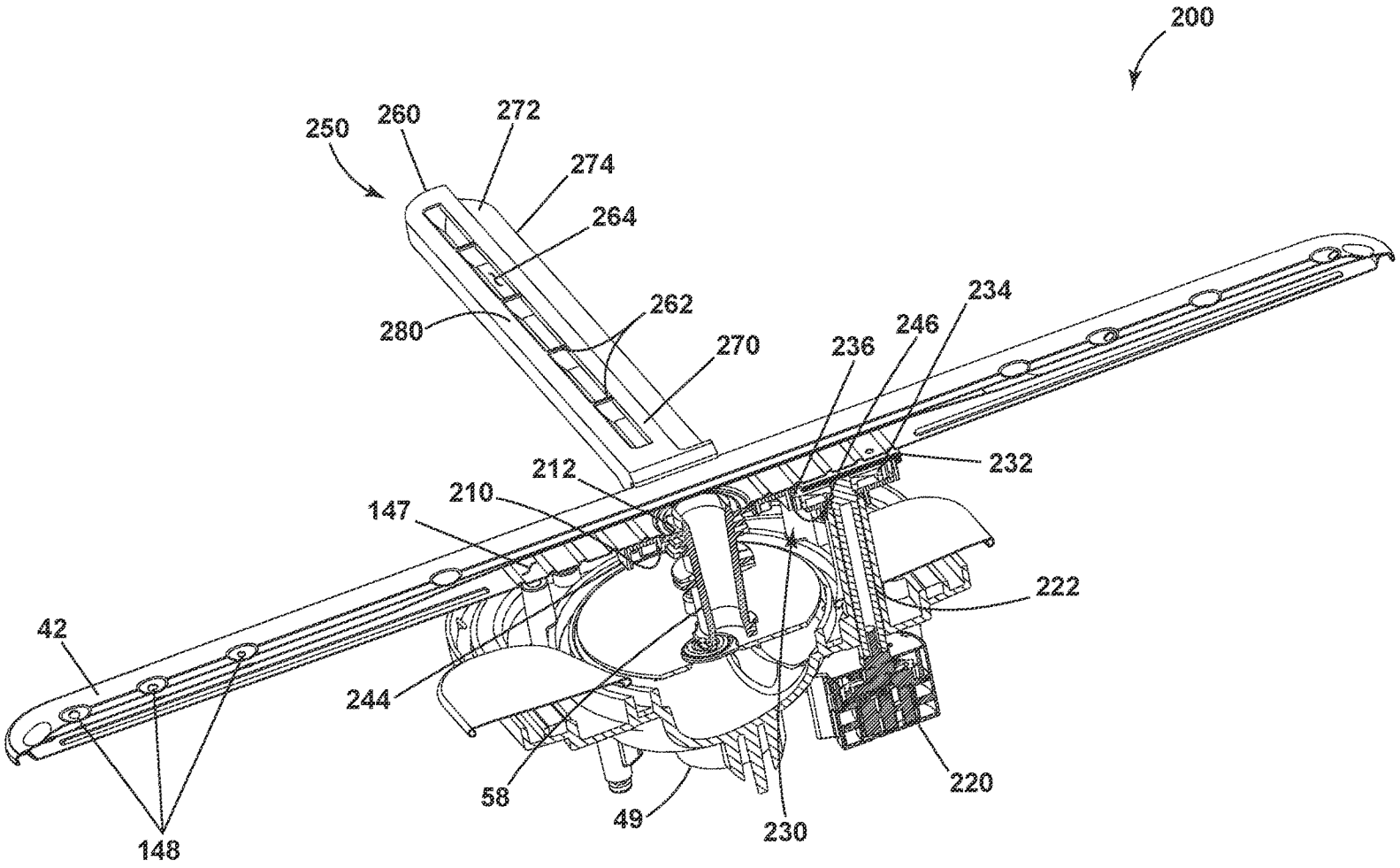
FIG. 5 is a side perspective cross-sectional view of the rotating arm assembly of FIG. 4, taken along line V-V of FIG. 4.

FIG. 5 is a cross section of FIG. 4 with the sloped or recess portion of the bottom wall 142 forming the sump 51 removed to better show the mounting of the rotating arm assembly 200, where it can be seen that the hub 210 further couples the rotating arm assembly 200, and therefore also the lower spray arm 42 and the air mixing arm 250, to the supply conduit 58. By way of non-limiting example, the hub 210 can mount the rotating arm assembly 200 to the supply conduit 58. The hub 210 has an opening, illustrated as a liquid conduit 212 that is fluidly coupled to both the lower spray arm 42 and to the supply conduit 58 to fluidly couple the supply conduit 58 to the lower spray arm 42 for supplying liquid from the supply conduit 58 to the lower spray arm 42 via the liquid conduit 212. The lower spray arm 42 has an at least partially hollow interior defining a liquid passage 147 and at least one spray opening 148, illustrated as a plurality of spray openings 148. The liquid conduit 212 thus fluidly couples the supply conduit 58 specifically with the liquid passage 147 of the lower spray arm 42. The spray openings 148 are fluidly coupled to the liquid passage 147 to emit liquid that is supplied from the supply conduit 58 to the liquid passage 147 into the treating chamber 16 via the spray openings 148.

The gear assembly 230 comprises a set of gears, illustrated as a driving gear 234 and a driven gear 244, operably coupling the output shaft 222 of the second motor 220 with the hub 210 and the air mixing arm 250. The driving gear 234 is coupled to and rotationally driven by the output shaft 222 and is at least partially received within a gear housing 232. At least a portion of the driving gear 234, such as a toothed outer surface 236 of the driving gear 234, has at least a portion that extends or protrudes from the gear housing 232 for engagement of the toothed outer surface 236 with the driven gear 244. The driven gear 244 likewise defines a toothed outer surface 246 that can mesh with the toothed outer surface 236 of the driving gear 234 such that rotation of the driving gear 234 rotationally drives the driven gear 244. In one non-limiting example, the driven gear 244 can be fixedly coupled with the hub 210, such as by being fixed to a lower portion of the hub 210 or by circumferentially surrounding at least a portion of the hub 210, such that rotation of the driven gear 244 concurrently rotates the hub 210. Alternatively, in another non-limiting example, the hub 210 itself can act as the driven gear 244, such as by having at least a portion of an outer circumference of the hub 210 defining the toothed outer surface 246 that meshes with the driving gear 234.

Figure 6:
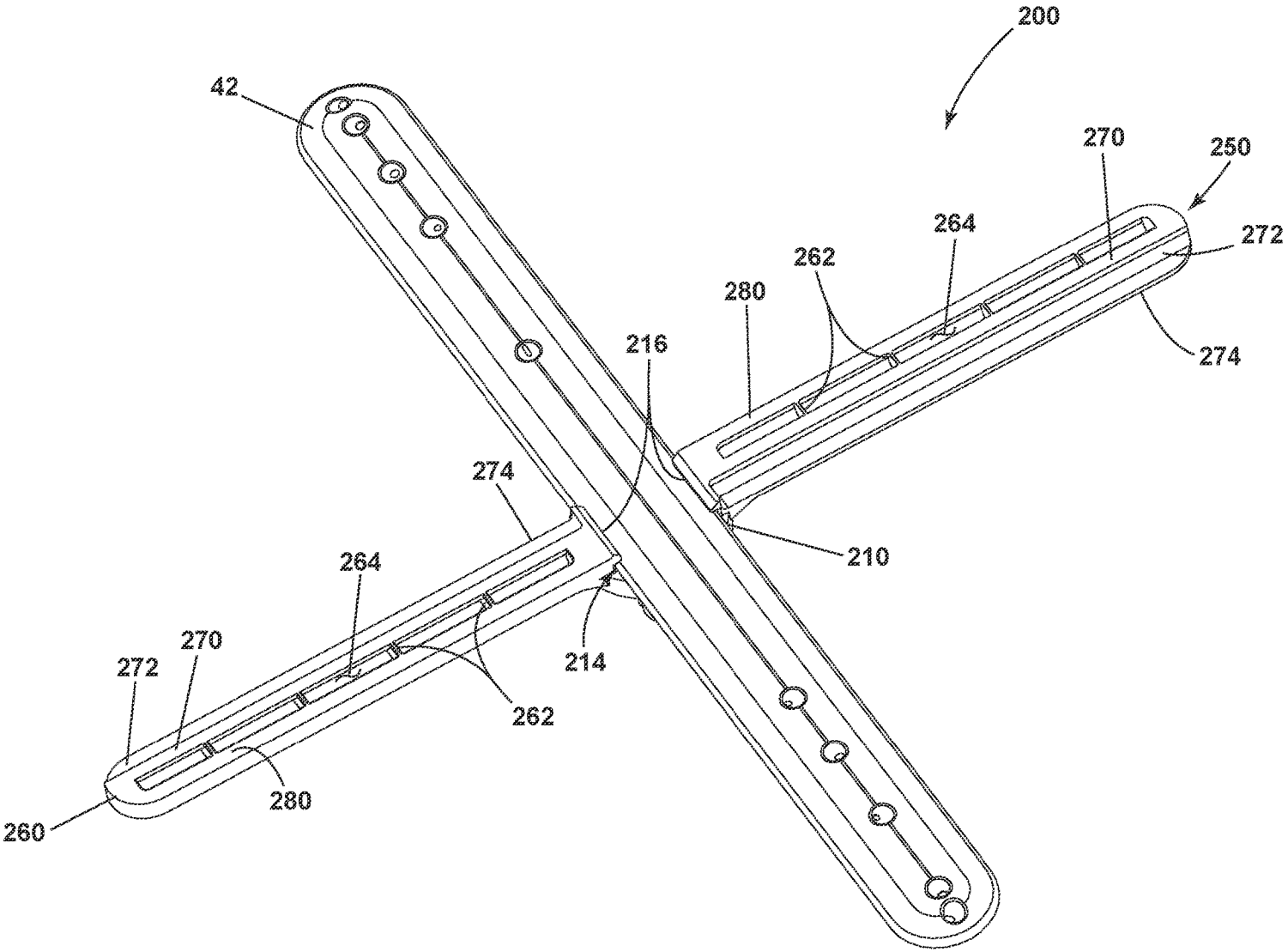
FIG. 6 is a top perspective view of a portion of the rotating arm assembly of FIG. 4, including the air mixing arm.

Turning now to FIG. 6, the coupling of the lower spray arm 42 with the air mixing arm 250 at the hub 210 comprises at least a portion of the lower spray arm 42 being at least partially received within and at least partially surrounded by a spray arm receiving channel 214 that is formed by the hub 210 and the longitudinal body 260 of the air mixing arm 250. The spray arm receiving channel 214 can further comprise at least one retaining flange 216, illustrated as a pair of retaining flanges 216, and configured to retain the lower spray arm 42 within the spray arm receiving channel 214, such as by an interference fit or a snap fit. In one non-limiting example, the spray arm receiving channel 214 can be defined at a central portion of the longitudinal body 260, such as at a midpoint of the longitudinal body 260, and can receive a central portion of the lower spray arm 42, such as at a midpoint of the lower spray arm 42. In this way, the coupling of the lower spray arm 42 and the air mixing arm 250 positions the lower spray arm 42 and the air mixing arm 250 such that they can be thought of as bisecting one another.

Figure 7:
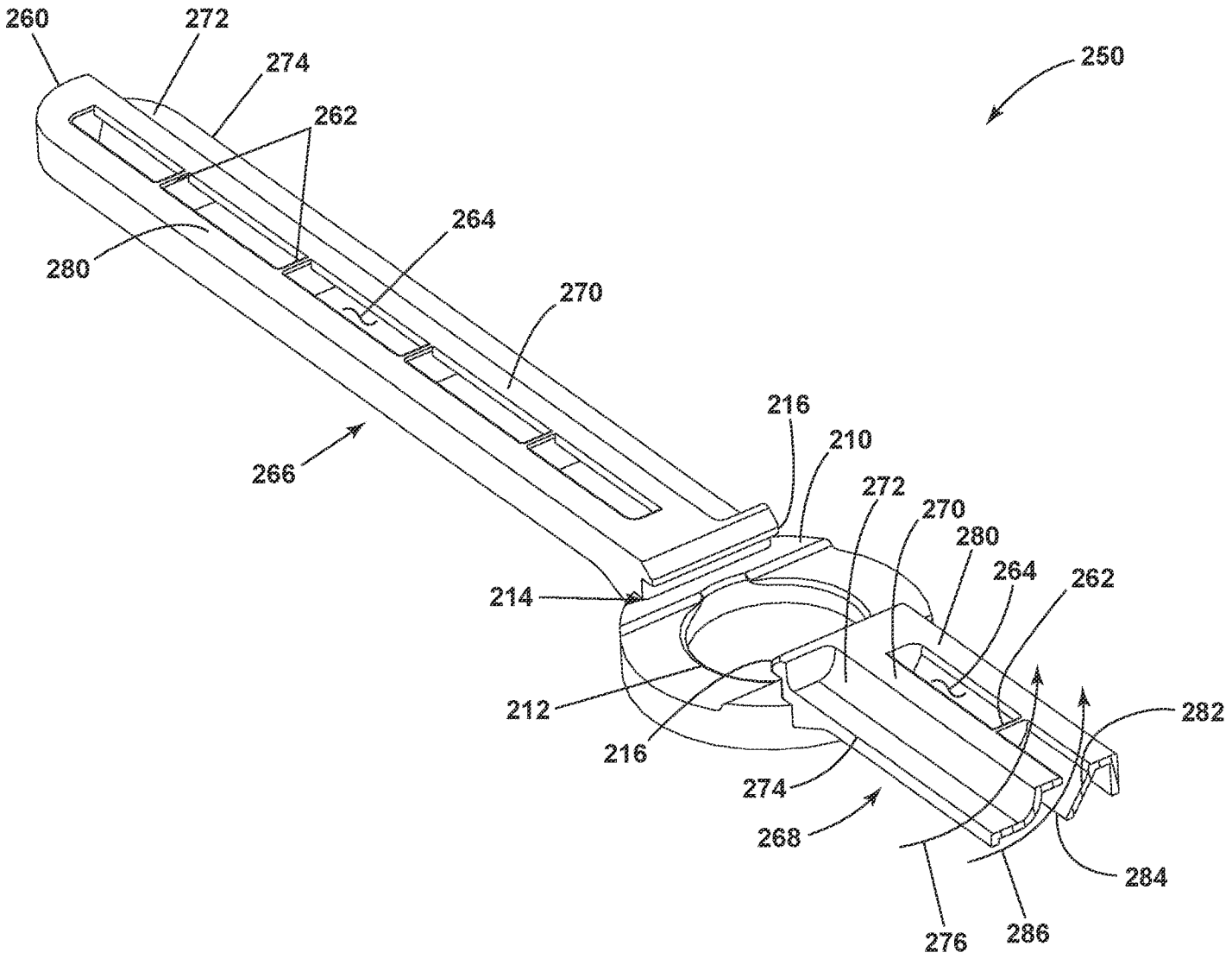
FIG. 7 is a perspective cross-sectional view of the air mixing arm of FIG. 4.

FIG. 7 is a cross section of a portion of FIG. 6, with the lower spray arm 42 removed to better show the hub 210 and the air mixing arm 250, where it can be seen that the longitudinal body 260 of the air mixing arm 250 extends outwardly from the hub 210. By way of non-limiting example, the longitudinal body 260 of the air mixing arm 250 can be coupled to or formed with the hub 210. The longitudinal body 260 can comprise first and second halves 266, 268 that are the same in shape and size and can collectively be thought of as forming the longitudinal body 260. The first and second halves 266, 268 are spaced laterally apart from one another by the spray arm receiving channel 214, such that the first and second halves 266, 268 extend outwardly from the hub 210 in opposite directions and from opposing sides of the hub 210, which can also be thought of as extending from opposing sides of the spray arm receiving channel 214 that are positioned opposite from one another about the liquid conduit 212. The retaining flanges 216 can be formed at the radially innermost ends of the first and second halves 266, 268, respectively. The first and second halves 266, 268 are also provided rotationally offset relative to one another, such as by being rotationally offset by 180 degrees, such that the leading surfaces 272 and leading edges 274 of both of the first and second halves 266, 268 are rotated forwardly as the air mixing arm 250 is rotated in the clockwise direction as seen from FIG. 7.

The cross-sectional portion of FIG. 7 better shows that the leading surface 272 of the front blade 270 defines a curved cross section. However, while the leading surface 272 is illustrated as having a curved cross section, it will be understood that this shape is not limiting and that the leading surface 272 can have other shapes, such as having a flat and angled cross section, or by the curved leading surface 272 having a different degree of curvature than what is shown. Regardless of the shape or degree of curvature or angle of the leading surface 272, the leading surface 272 can act as a ramp for air within the treating chamber 16 that is confronted by the leading edge 274 and leading surface 272. In the example of the curved leading surface 272 as shown, the curved leading surface 272 directs air upwardly from the air mixing arm 250, along an upward air flow path 276 as shown by the arrow 276.

The rear blade 280 also defines a leading surface 282 that at least partially defines the at least one air flow channel 264 between the front and rear blades 270, 280, such that the at least one air flow channel 264 can be thought of as a slot provided in the air mixing arm 250 that helps to define the leading surface 282. The leading surface 282 extends forwardly from the rear blade 280 moving from an upper portion of the rear blade 280 to a lower portion of the rear blade 280 to terminate at a leading edge 284 at a lowermost and forwardmost extent of the rear blade 280. The leading surface 282 is angled between the leading edge 284 and the rear blade 280 such that air that confronts the leading surface 282 as the air mixing arm 250 is rotated in the clockwise direction flows upwardly along the angled leading surface 282 through the at least one air flow channel 264. However, while the leading surface 282 is illustrated as being angled, it will be understood that the leading surface 282 could alternatively be provided as a curved leading surface 282, having a shape similar to the curved leading surface 272, and which can have a degree of curvature that is the same as or different from the degree of curvature of the curved leading surface 272. The leading surfaces 272, 282 can be the same or different in cross-sectional shape. Regardless of the shape or degree of curvature or angle of the leading surface 282, the leading surface 282 can act as a ramp for air within the treating chamber 16 that is confronted by the leading edge 284 and leading surface 282. In the example of the angled leading surface 282 as shown, the angled leading surface 282 directs air upwardly from the air mixing arm 250, along an upward air flow path 286 as shown by the arrow 286.

Figure 8:
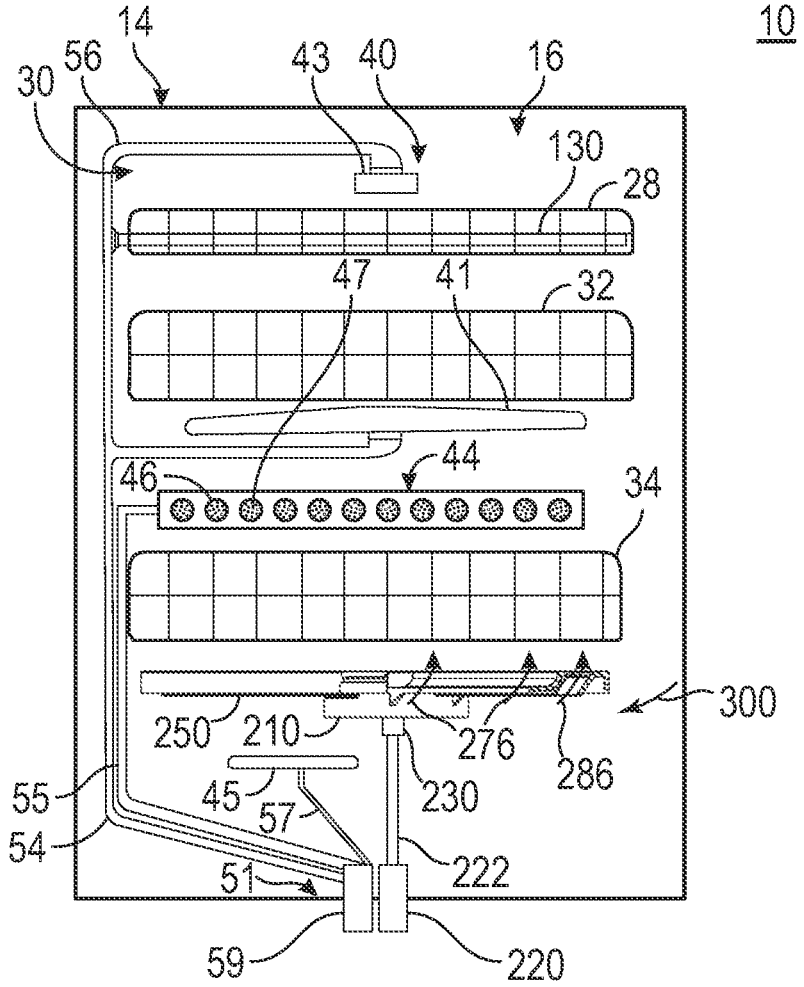
FIG. 8 is a schematic view of a portion of the dishwasher of FIG. 1, including a cross-sectional view of the air mixing arm of FIG. 7.

FIG. 8 is a schematic view of the dishwasher 10 with a cross section of a portion of the air mixing arm 250, and with the lower spray arm 42 removed to better show the air mixing arm 250 and the upward air flow paths 276, 286. Turning now to the operation of the rotating arm assembly 200, the controller 22 can operate the second motor 220 to rotate the hub 210 and the rotating arm assembly 200, via the output shaft 222 and the gear assembly 230, such as in the clockwise direction as illustrated by the arrow 300. In one example, when the second motor 220 rotates the hub 210 and the rotating arm assembly 200, and thus also the air mixing arm 250, in the clockwise direction 300, the leading surfaces 272, 282 of the first and second halves 266, 268 exert a confronting force against the air in the treating chamber 16 as the air mixing arm 250 rotates and act as ramps, causing the air to be directed to move upwardly along the leading surfaces 272, 282 and further upwardly from the air mixing arm 250, along the upward air flow paths 276, 286. Such air flow along the upward air flow paths 276, 286 establishes an upward air flow through the treating chamber 16 along the extent of the longitudinal body 260. Thus, depending on the pattern of movement of air within the treating chamber 16 that is desired, the shape and angle or curvature of the leading surfaces 272, 282 can be selected to produce the desired direction or angle for air movement within the treating chamber 16, allowing for improved drying performance by ensuring more evenly distributed air flow throughout the treating chamber 16, as compared to drying phases within which drying performance may be impaired due to air not being circulated evenly throughout the treating chamber 16, and by reducing or eliminating air flow dead zones with little or no air circulation that may exist without the air mixing arm 250. Since the leading surfaces 272, 282 can differ from one another in cross-sectional shape, angle, or curvature, etc., the single air mixing arm 250 having the front and rear blades 270, 280 allows for the air mixing arm 250 to move air in more than one direction or pattern.

Such improvement in the air movement and the distribution of air flow throughout the treating chamber 16 can be further improved and customized by the relative positioning of the treating chamber air inlet, the treating chamber air outlet, and the rotating arm assembly 200. In the illustrated example, the rotating arm assembly 200 is positioned within the tub 14, above the bottom wall 142 and below at least one of the dish racks 28, 32, 34, shown herein as being below the lower dish rack 34. The treating chamber air inlet, comprising at least one of the outlet of the serpentine conduit 83 at the lower portion of the tub 14 or the vent 190, is positioned below at least one of the dish racks 28, 32, 34, such as, by way of non-limiting example, below the lower dish rack 34 and below the rotating arm assembly 200. The treating chamber air outlet, comprising at least one of the inlet of the serpentine conduit 83 at the upper portion of the tub 14 or the inlet 160 of the drying system 150, is positioned above at least one of the dish racks 28, 32, 34, such as above at least the lower dish rack 34.

Such positioning of the treating chamber air inlet at the lower portion of the tub 14, the treating chamber air outlet at the upper portion of the tub 14, and the rotating arm assembly 200 located between the air inlet and the air outlet, but still at the lower portion of the tub 14, further ensures improved air movement and air distribution throughout the treating chamber 16. For example, air that is drawn into the treating chamber 16 through the air inlet can then be moved within the treating chamber 16, such as by being quickly drawn to the air mixing arm 250 by the negative pressure or temporary low pressure created by rotation of the rotating arm assembly 200, which serves to direct the air flow both upwardly from the air mixing arm 250, as well as drawing the air flow to spread out laterally within the treating chamber 16, along both the first and second halves 266, 268 of the longitudinal body 260. With the treating chamber air outlet located at the upper portion of the tub 14, the upward air flow within the treating chamber 16 continues along the height of the treating chamber 16 before being drawn to or driven to the treating chamber air outlet to be expelled out the air outlet, thus establishing air flow and improved distribution throughout the treating chamber 16.

The negative pressure or temporary low pressure created by rotation of the rotating arm assembly 200 can also result in additional air being drawn into the treating chamber 16 through the treating chamber air inlet, thus increasing the rate of air flow through the treating chamber 16 over that of the dishwasher 10 without the air mixing arm 250 included, further improving drying performance due to the increased air flow through the treating chamber 16 to take up more moisture from the dish items. The rotation of the rotating arm assembly 200 and the air mixing arm 250 also provides a greater increase in air flow rate through the treating chamber 16 than rotation of the lower spray arm 42 would without the inclusion of the rotating arm assembly 200, because the second motor 220 drives rotation of the air mixing arm 250 at speeds greater than the first motor 49 drives rotation of the lower spray arm 42. While rotation of the lower spray arm 42 by the first motor 49 does, in turn, drive rotation of the air mixing arm 250, due to the air mixing arm 250 being carried with the lower spray arm 42 at the hub 210, the first motor 49 generally drives rotation of the lower spray arm 42 at about 20-30 revolutions per minute (RPM). However, the second motor 220 drives rotation of the hub 210, and thus also the lower spray arm 42 and the air mixing arm 250, at higher speeds, such as, by way of non-limiting example, at least 90 RPM, further at least 95 RPM, and further yet at about 100 RPM. Thus, rotation of the air mixing arm 250 at the higher speeds of the second motor 220 will result in a greater increase of air flow rate through the treating chamber 16 than if the rotation were driven by the first motor 49 via the lower spray arm 42, thus producing a larger improvement in drying performance due to the increased air flow rate.

The aspects described herein set forth a rotating arm assembly including an air mixing arm for use within a dish treating appliance that can aid in moving air throughout the treating chamber, in increasing air flow rate through the treating chamber, and in more evenly distributing air flow throughout the treating chamber to avoid dead zones and to improve drying performance. Such an air mixing arm can be provided within a variety of dishwashers utilizing a variety of different drying systems, including open loop or closed loop condensing drying systems, open loop or closed loop fan-assisted drying systems, active vent drying systems, and drying systems including a door opener to partially open the dishwasher door during or at the end of a drying cycle. Further, the air mixing arm can be provided about an existing spray arm, thus allowing the air mixing arm to be installed even in dishwashers that were not originally manufactured to include such an air mixing arm. The air mixing arm includes parallel blades, such that the number, position, shape, size, or angle of the blades and their leading surfaces can be varied and provided to result in the specific air movement patterns and distributions that are desired within the treating chamber. Further yet, the speed of rotation achievable by the air mixing arm provides additional opportunity to add to and to customize the direction and flow rate of air movement within the treating chamber. These various aspects allow for improved control of the air flow within the treating chamber of the dishwasher to improve the efficiency of the drying phase or to otherwise improve a cycle of operation.

It will also be understood that various changes and/or modifications can be made without departing from the spirit of the present disclosure. By way of non-limiting example, although the present disclosure is described for use with a dishwasher having a door assembly pivotable about a horizontal axis, it will be recognized that the spray arm can be employed with dishwashers having various constructions, including dishwashers with door assemblies pivotable about a vertical axis and/or drawer-style dishwashers.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to an automatic cycle of operation, the dishwasher comprising:

a tub at least partially defining a treating chamber with an access opening;

a door selectively closing the access opening;

at least one dish rack located within the treating chamber;

an air inlet fluidly coupled to the treating chamber;

an air outlet fluidly coupled to the treating chamber;

a rotating arm assembly located within the tub below the at least one dish rack and having a rotatable hub with a liquid conduit, a spray arm carried by the rotatable hub and fluidly coupled to the liquid conduit, and an air mixing arm carried by the rotatable hub and rotationally spaced from the spray arm; and a motor having an output shaft extending into the tub, the output shaft operably coupled to the rotatable hub to provide a rotational driving force thereto and wherein rotation of the rotatable hub rotates the air mixing arm to move air within the treating chamber whereby air is drawn in through the air inlet and is expelled out the air outlet to establish air flow through the treating chamber.

2. The dishwasher of claim 1, further comprising a fan fluidly coupled to one of the air inlet or the air outlet.

3. The dishwasher of claim 2 wherein the fan is located at the air outlet.

4. The dishwasher of claim 3 wherein the air inlet is located below the at least one dish rack and the air outlet is located above the at least one dish rack.

5. The dishwasher of claim 4 wherein the tub defines a bottom wall and the rotating arm assembly is located above the bottom wall and below the at least one dish rack.

6. The dishwasher of claim 5 wherein the air inlet is located below the rotating arm assembly.

7. The dishwasher of claim 6 wherein the air mixing arm comprises multiple, parallel blades.

8. The dishwasher of claim 1 wherein the air inlet fluidly couples the treating chamber to ambient air, and further wherein the air outlet fluidly couples the treating chamber to ambient air.

9. The dishwasher of claim 1 further comprising a condenser that is fluidly coupled to the air inlet and the air outlet.

10. The dishwasher of claim 1 wherein the spray arm and the air mixing arm are rotationally offset by 90 degrees.

11. The dishwasher of claim 1 wherein the air mixing arm is stationary relative to the spray arm.

12. The dishwasher of claim 1 wherein the air mixing arm has a leading surface with a curved cross section.

13. The dishwasher of claim 1, further comprising another motor rotationally driving the spray arm.

14. The dishwasher of claim 13 wherein the motor rotationally driving the air mixing arm, during a dying phase, operates at a speed greater than the another motor drives the spray arm.

15. A dishwasher for treating dishes according to an automatic cycle of operation, the dishwasher comprising:

a tub at least partially defining a treating chamber with an access opening;

a door selectively closing the access opening;

at least one dish rack located within the treating chamber;

a rotating arm assembly located within the tub below the at least one dish rack and having a rotatable hub with a liquid conduit, a spray arm carried by the rotatable hub and fluidly coupled to the liquid conduit, and an air mixing arm carried by the rotatable hub and rotationally spaced from the spray arm, the air mixing arm comprising multiple, parallel blades; wherein rotation of the rotatable hub rotates the air mixing arm to move air within the treating chamber to establish air flow through the treating chamber;

a first motor rotationally driving the spray arm; and a second motor rotationally driving the air mixing arm, independently of the first motor, and at a speed greater than the first motor drives the spray arm and wherein the second motor, comprises an output shaft operably coupled to and extending from the second motor and into the tub.

16. The dishwasher of claim 15, further comprising a set of gears operably coupling the output shaft with the air mixing arm.

17. A dishwasher for treating dishes according to an automatic cycle of operation, the dishwasher comprising:

a tub at least partially defining a treating chamber with an access opening;

a door moveable to selectively close the access opening;

at least one dish rack located within the treating chamber;

a rotating arm assembly located within the treating chamber below the at least one dish rack, the rotating arm assembly including a hub with a liquid conduit, a spray arm carried by the hub and fluidly coupled to the liquid conduit, and an air mixing arm carried by the hub and rotationally spaced from the spray arm; and a motor having an output shaft extending into the tub, the output shaft operably coupled to at least one of the hub or the air mixing arm to provide a rotational driving force thereto.

* * * * *